United States Patent [19]

Allgood

[11] 4,030,265

[45] June 21, 1977

[54] ARCH BEAMS AND PLATES

[76] Inventor: Jay R. Allgood, 1888 Lyndhurst, Camarillo, Calif. 93010

[22] Filed: Oct. 24, 1975

[21] Appl. No.: 625,395

[52] U.S. Cl. ..... 52/723; 52/722; 52/223 R; 52/339; 52/86

[51] Int. Cl.[2] ..... E04C 3/34; E04C 3/10

[58] Field of Search ..... 52/723, 722, 223, 596, 52/734, 726, 740, 338, 339, 329, 615, 618, 309, 724, 725, 86

[56] References Cited

UNITED STATES PATENTS

| | | | |
|---|---|---|---|
| 339,296 | 4/1886 | Jackson | 52/723 |
| 864,619 | 8/1907 | DeMan | 52/734 |
| 880,468 | 2/1908 | Robinson | 52/339 |
| 902,204 | 10/1908 | Brown | 52/723 |
| 1,021,429 | 3/1912 | Scott | 52/723 |
| 1,573,280 | 2/1926 | Simpson | 52/723 |
| 1,709,028 | 4/1929 | Lathrop | 52/338 |
| 3,300,932 | 1/1967 | Ratliff, Jr. | 52/339 |
| 3,327,441 | 6/1967 | Kelly | 52/615 |
| 3,385,002 | 5/1968 | Quinif | 52/615 |
| 3,753,843 | 8/1973 | Hutchison | 52/615 |

FOREIGN PATENTS OR APPLICATIONS

| | | | |
|---|---|---|---|
| 783,334 | 4/1968 | Canada | 52/724 |
| 202,332 | 3/1959 | Austria | 52/339 |
| 806,723 | 6/1951 | Germany | 52/239 |
| 825,883 | 12/1951 | Germany | 52/339 |
| 805,551 | 5/1951 | Germany | 52/329 |
| 362,020 | 8/1938 | Italy | 52/329 |
| 362,289 | 12/1938 | Italy | 52/329 |
| 164,468 | 12/1933 | Switzerland | 52/339 |

*Primary Examiner*—Price C. Faw, Jr.
*Assistant Examiner*—Robert C. Farber
*Attorney, Agent, or Firm*—Richard S. Sciascia; Joseph M. St.Amand

[57] ABSTRACT

An arch beam comprising a tied arch with a low modulus filler between the compression and tension elements. A filler and wearing surface are used over the arch to form a horizontal surface and to distribute the load where desired. The filler serves to provide elastic support for the low rise arch compression member, thereby greatly increasing its buckling resistance.

18 Claims, 6 Drawing Figures

Fig. 2.
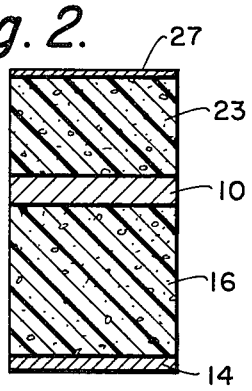
Fig. 4.
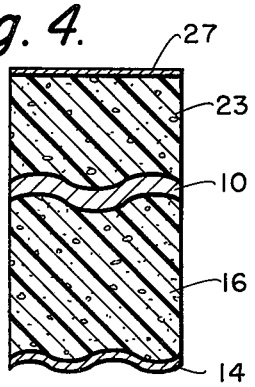
Fig. 5.
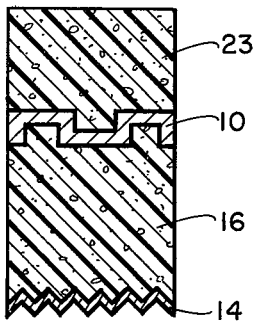
Fig. 3. MID-SPAN CONCENTRATED LOADING OF ARCH-BEAM WITH FILLER
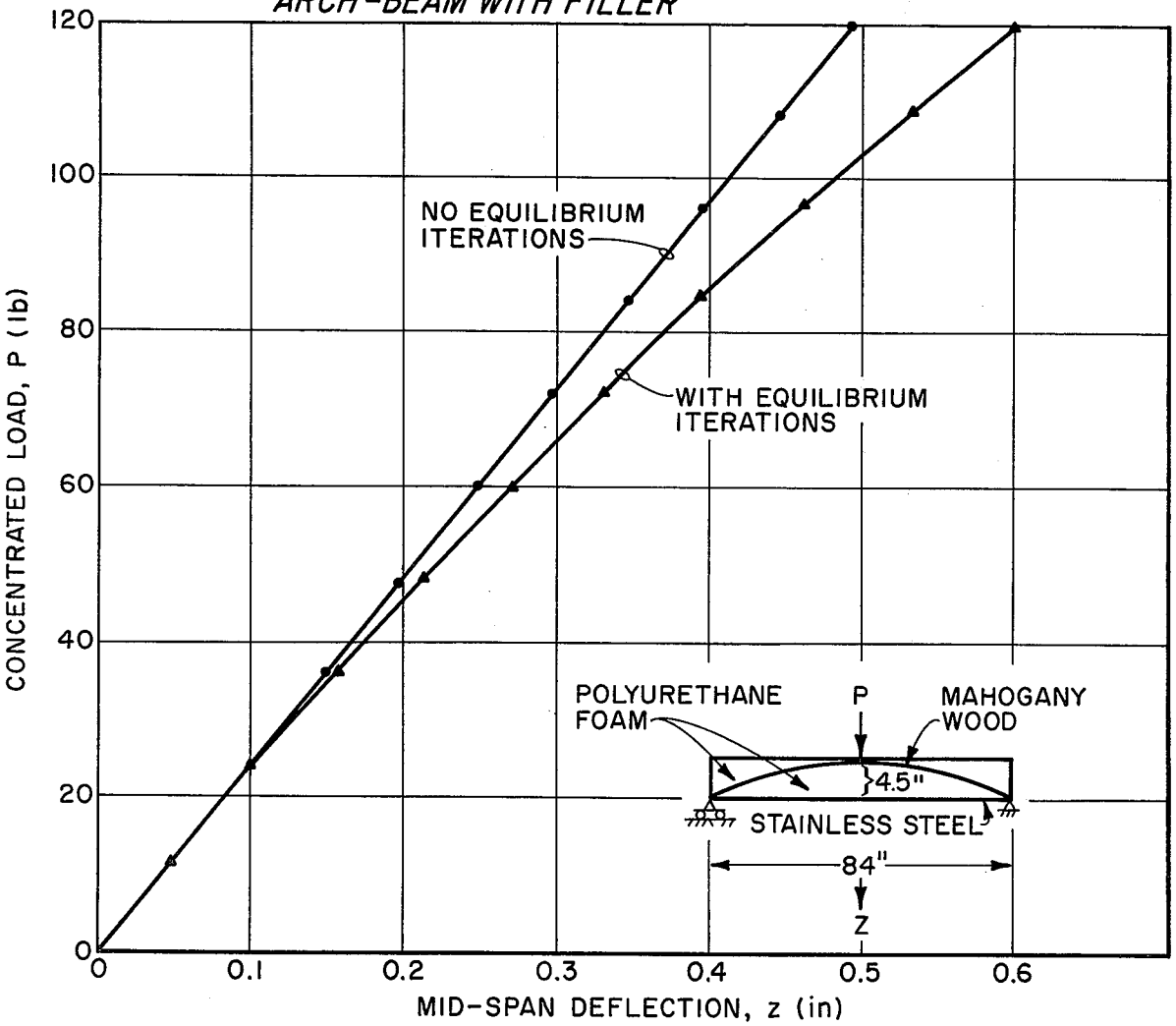

ARCH BEAMS AND PLATES

STATEMENT OF GOVERNMENT INTEREST

The invention described herein may be manufactured and used by or for the Government of the United States of America for governmental purposes without the payment of any royalties thereon or therefor.

BACKGROUND AND SUMMARY OF THE INVENTION

This invention relates to structural members and particularly to improved arch-beams and arch-plates for carrying loads across open spans.

Loads are normally carried over open spans by flexural members such as beams or plates. These members are inherently inefficient in that only a small portion of each is stressed to the allowable working level. Because they are inefficient, arches are operably used over longer spans where relatively high rise-span ratios are tolerable. Where small rise-span ratios are required, arches are often unsatisfactory because buckling becomes a problem. Further, arches do not normally have the flat upper surface that is often required.

The inefficiency of normal flexural elements and the limitations of ordinary shallow arches are largely overcome by the arch-beam of this invention.

The arch-beam is a tied arch with a low cost filler of polyurethane form or other material between the compression and tension elements. Filler may also be placed above the arch to provide a horizontal upper surface if desired. The filler provides elastic support for the arch, thereby greatly increasing the transitional buckling load. By varying the choice of materials for the tension, compression and filler elements, the arch-beam becomes a remarkably synergistic, highly efficient load carrying system. The arch-plate is merely an arch-beam extended in the horizontal plane. The arch-beam overcomes disadvantages of both the beam and the arch.

A principal advantage of the arch-beam over conventional flexural elements is that the materials employed are used at a much higher efficiency. With proper design and for symmetrical loading, essentially all of the compression and tensile elements can be at the allowable working stress. Also, deflections are much easier to control than in conventional flexural elements.

The main new feature of the structural member disclosed herein is the utilization of elastic support to vastly increase the transitional buckling load of a shallow arch. Internal confinement of the arch is similar to the soil confinement of a culvert. In both cases the transitional buckling load is increased by an order of magnitude or more.

Another advantage of the arch-beam is that is permits large reductions in dead load and, consequently, will permit a much larger percentage of the available resistance to be utilized in carrying live loads.

BRIEF DESCRIPTION OF THE DRAWINGS

FIG. 2 is a cross-sectional view of the arch-beam of FIG. 1 taken along line 2—2.

FIG. 3 shows a plot of load versus deflection for a typical arch-beam of this invention.

FIG. 4 is a longitudinal cross-sectional view, similar to FIG. 1 for another embodiment of the invention where the tensile element is in the form of a catenary.

FIGS. 5 and 6 show various cross-sectional views across the width of different arch-beams.

DESCRIPTION AND OPERATION

Figure 1:
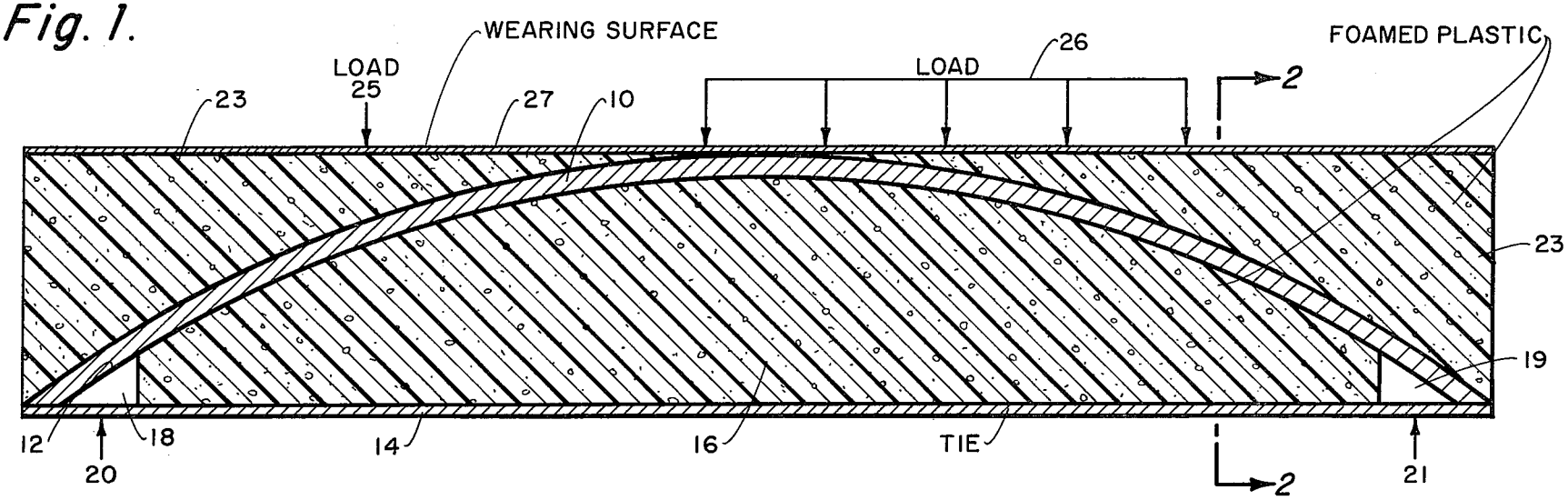
FIG. 1 is a longitudinal cross-sectional view of a preferred embodiment of the invention.

A simple arch-beam embodiment is shown in cross-section in FIGS. 1 and 2. In this embodiment, an arch 10 has its ends 12 and 13 fastened to opposite ends of a tie element 14 such that ends 12 and 13 react against each other through tie element 14. Arch 10 may be made from a variety of high compression strength materials such as concrete, wood, steel, etc., and tie element 14 is made of steel or other high tensile strength material. Arch 10 and tie element 14 are held in proper position with respect to each other by a filler material 16 which completely occupies the space between the arch 10 and tie element 14. A low modulus material such as polyurethane foam may be used for filler material 16. Small reaction blocks 18 and 19 may be used at the intersections of arch 10 and tie element 14 to distribute the stress concentration from reaction forces at support points 20 and 21. Filler material may also be used above arch 10 at 23 to distribute concentrated 25 or other loads 26 to the arch and/or to support a wearing surface or roofing 27 as may be desired. Any suitable wearing surface can be applied to the top of the beam.

Various cross-sections of the beam, such as the cross-section of FIG. 2, for example, may be of the same or different widths or even of variable widths with depth, and may be of a variety of materials. For example, concrete for the arch, steel for the tie, and polyurethane foam for the filler is one combination. A mahogany wood arch, a stainless steel tie, and polyurethane filler is another combination.

The arch-beam transfers load in essentially pure compression through the arch to the supports at 20 and 21. Response is slightly non-linear as is indicated in the plot of load versus deflection shown in FIG. 3 for a mahogany wood arch with a stainless steel tie and polyurethane filler. While there are several potential failure modes including buckling of the arch, compressive yielding of the filler, and tensile yielding of the tie, the designer has the option of predetermining the failure mode; however, normally yielding of the tie will be the preferred failure mode.

Figure 6:
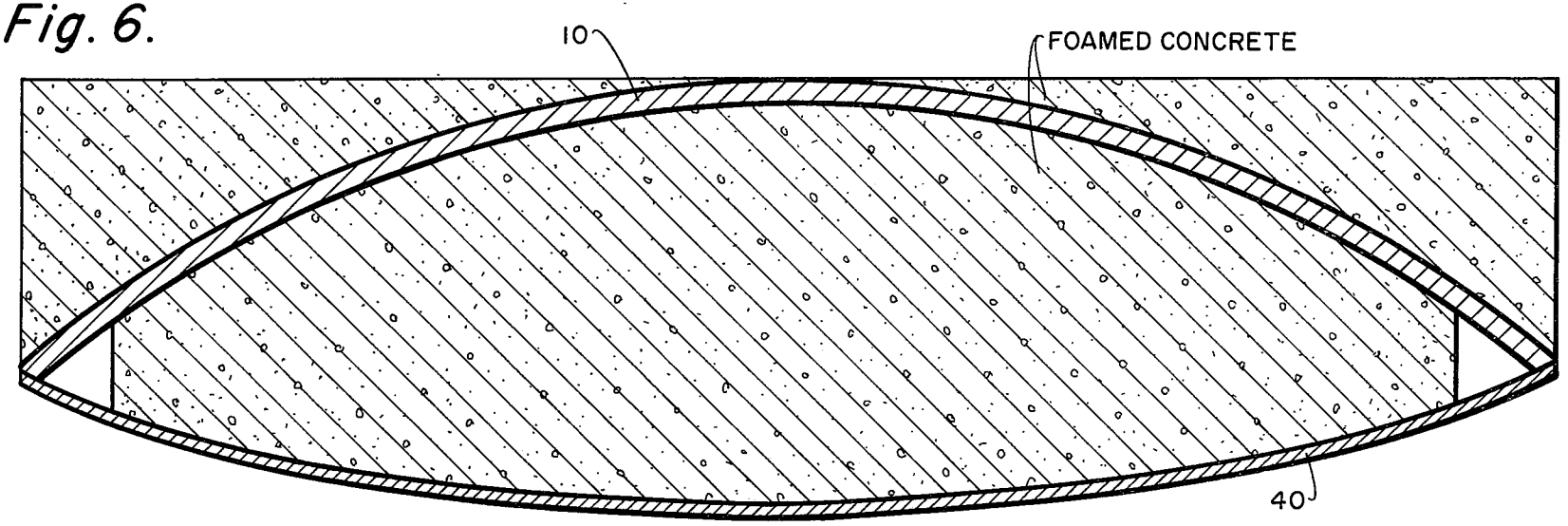

A variety of geometric variations from that indicated in FIG. 1 are possible. For example, a cross-section of the arch element 10 may be corrugated (square, curved, etc.) as shown in FIGS. 4 and 5 or of other cross-sections than the rectangular cross-section shown in FIG. 2. Also, the tensile element, i.e., tie element can be in the shape of a catenary 40, as shown in FIG. 6. Likewise, the tie element cross-section can also utilize a variety of shapes and materials, as previously mentioned and also shown in FIGS. 5 and 6. Use of voids, where permissible, would permit a reduction in the amount of filler required. In addition, the supports used and end connection details can vary widely.

Where the tensile element is in the shape of a catenary 30, a high strength foam, such as foam cement (e.g., Merelcrete), a foam polystyrene, high strength polyurethane and the like, having greater compression strength, is used.

When the exposed surfaces of the foamed material is in an area protected from the elements, a protective coating or covering is unnecessary. However, in areas exposed to the elements, the surfaces of the foam filler open to the elements should be protected with a suitable coating or covering. Methyl merthacrilate, for instance, can be used to impregnate the exposed foam surface to provide a hard finish thereon. Otherwise, a cement mortar, or plaster coating, or other protective surface can be used on exterior surface of the arch-beam. The entire structure can be coated with a plastic, or fiberglass and plastic coating, etc., for retaining the foam filler material in place and for otherwise protecting the structure from the elements.

The use of the tied arch with small rise-span ratios together with the use of a light weight filler to prevent buckling that would otherwise occur in tied arches with with thin elements and with small rise-span ratios are unique features of the device of this invention. Also, the use of light weight filler to achieve rectangular longitudinal sections, where desired, in this type structure is also novel.

Obviously, many modifications and variations of the present invention are possible in the light of the above teachings. It is therefore to be understood that within the scope of the appended claims the invention may be practiced otherwise than as specifically described.

What is claimed is:

1. A low-rise light-weight synergistic arch-beam utilizing elastic support to vastly increase the transitional buckling load of a shallow arch and permitting large reductions in dead load, comprising:

a. a compression element in the form of an elongated low-rise arch member of high compression strength material;

b. a tie element of high tensile strength material;

c. the opposite ends of said arch member being fastened to respective opposite ends of said tie element such that the opposite ends of said arch member react against each other through said tie element; said joined arch member and tie element being supported at said opposite ends thereof;

d. an elastic support means of low modulus material filling the space between said arch and said tie element and being internally confined therebetween to form a tied arch-beam structure;

e. said low modulus material operating to hold said arch and tie element apart except where fastened together at said opposite ends thereof and to maintain proper position with respect to each other for greatly increasing the transitional buckling load of the resultant arch-beam structure such that the arch-beam structure transfers load in essentially pure compression through said arch member to said supports at the opposite ends thereof; said elastic support means of low modulus material allowing a significant decrease in the material normally required for forming said low-rise arch member and still support a given load that would otherwise exceed the buckling load of said arch member and normally cause collapse of the low-rise arch member;

f. the tensile strength of said tie element normally determining the failure mode of the arch-beam structure;

g. said synergistic arch-beam providing greater ease in deflection control over conventional flexural elements, thereby permitting a much greater percentage of available resistance to be utilized in carrying live loads; the limitations of ordinary shallow arches and the inefficiency of conventional flexural elements being eliminated therein.

2. A structural member as in claim 1 wherein a low modulus filler material is also provided between the top of said arch member and a horizontal surface above said arch member for distributing concentrated and other loads to the arch-beam.

3. A structural member as in claim 2 wherein a wearing surface is provided on the horizontal surface above said arch.

4. A structural member as in claim 2 wherein a reaction block is provided at each intersection of said arch member and said tie element at the opposite ends thereof to distribute stress concentration from any reaction forces at the points of support.

5. A structural member as in claim 2 wherein exterior exposed surfaces of said filler material are provided with a protective coating.

6. A structural member as in claim 2 wherein said tie element is flat.

7. A structural member as in claim 2 wherein said tie element is in the form of a catenary.

8. A structural member as in claim 1 wherein said entire arch-beam is provided with a coating for retaining the filler material between said arch member and said tie element and for protecting the arch-beam from the elements.

9. A structural member as in claim 2 wherein said entire arch-beam is provided with a coating for retaining said filler material and for protecting the arch-beam from the elements.

10. A structural member as in claim 2 wherein the cross-sectional shape of said arch member across the width thereof is rectangular.

11. A structural member as in claim 2 wherein the cross-sectional shape of said arch member across the width thereof is corrugated.

12. A structural member as in claim 2 wherein the material of said arch element is wood.

13. A structural member as in claim 2 wherein the material of said arch element is concrete.

14. A structural member as in claim 2 wherein the material of said arch element is steel.

15. A structural member as in claim 2 wherein the material of said tie element is steel.

16. A structural member as in claim 2 wherein said filler material is foamed cement.

17. A structural member as in claim 2 wherein said filler material is foamed polystyrene.

18. A structural member as in claim 2 wherein said filler material is polyurethane foam.

* * * * *